United States Patent [19]

McKee

[11] 4,033,397

[45] July 5, 1977

[54] ROLL BAR DEVICE FOR RETRACTABLE AWNINGS

[75] Inventor: Donald S. McKee, Louisville, Colo.

[73] Assignee: The Scott & Fetzer Company, Lakewood, Ohio

[22] Filed: Nov. 26, 1975

[21] Appl. No.: 635,709

[52] U.S. Cl. ..... 160/393; 160/245; 160/67; 242/71.8

[51] Int. Cl.[2] ..... A47H 13/00; E04F 10/00

[58] Field of Search ..... 160/66–75, 160/23, 238, 242–245, 263, 265, 310, 323, 324–326, 330, 391, 393, 401

[56] References Cited

UNITED STATES PATENTS

| | | | |
|---|---|---|---|
| 2,104,261 | 1/1938 | Landau | 160/330 |
| 3,263,735 | 8/1966 | Vecchiarelli et al. | 160/67 |
| 3,789,904 | 2/1974 | Takazawa | 160/263 |
| 3,918,510 | 11/1975 | Hayward | 135/5 AT |
| 3,918,511 | 11/1975 | Upton, Jr. | 160/71 |

*Primary Examiner*—Peter M. Caun
*Attorney, Agent, or Firm*—Gary M. Polumbus

[57] ABSTRACT

A roll bar adapted for attachment along one edge of an awning sheet so that the awning sheet can be retracted around the roll bar or extended away from the roll bar includes a generally cylindrical tubular element having longitudinally extending indentations therein with a generally circular groove in the indentation which is partially defined by a pair of upstanding lips having a space therebetween into which the awning sheet can be inserted. The edge of the awning sheet inserted into the groove has a sleeve formed therein which receives an elongated rod which is larger in diameter than the spacing between the lips so that the rod cooperates with the lips in retaining the edge of the awning sheet in the roll bar. The lips are designed such that the ends thereof can be flared outwardly to facilitate insertion of the awning sheet into the groove without snagging and possibly damaging the awning sheet material. The roll bar further includes a plurality of screw-receiving openings in opposite ends thereof to facilitate attachment of an end cap thereto. The end cap has a plurality of spaced dogs around its perimeter and the angular relationship of the dogs to the roll bar is adjustable by variable utilization of the screw-receiving openings in the end of the roll bar with screw-type fasteners extending through the end cap and into the roll bar.

6 Claims, 10 Drawing Figures

ROLL BAR DEVICE FOR RETRACTABLE AWNINGS

BACKGROUND OF THE INVENTION

Retractable awnings have typically utilized a roll bar connected to the awning sheet to wrap the awning sheet about when storing the awning. The roll bar may be positioned adjacent the supporting surface for the awning or may be of the type which extends away from the supporting surface and thereby serves as a lead bar along an outer edge of the awning.

A common system for attaching an edge of the awning sheet to the roll bar is by providing an elongated groove along the length of the roll bar with the groove having a slotted opening therealong so that the edge of the awning sheet can be inserted into the groove through the slot. The awning sheet is secured in the slot by extending a rod through a sleeve provided in the edge of the awning sheet and inserting the rod with the awning sheet into the groove of the roll bar. The rod has a larger diameter than the slotted opening in the groove so that the rod will secure the edge of the awning sheet in the roll bar. An example of such a system for connecting an awning sheet to a roll bar is disclosed in U.S. Pat. No. 3,866,874 of Albert E. Upton, Jr. which is of common ownership with the present application.

While this system for connecting the awning sheet to the roll bar has proved to provide a positive and reliable connection, it has been found that when inserting the awning sheet into the groove, the awning will typically snag and sometimes be damaged by the edges of the slot at the end of the roll bar where the awning sheet is being inserted into the slot.

Further, particularly in awnings of the type disclosed in the aforementioned patent of Albert E. Upton, Jr., the roll bars are provided with an end cap having studs thereon adapted to abut a bracket or other member on the supporting surface for the awning to prevent the roll bar from rotating when in a retracted storage position. It has been found that the studs must be positioned in a particular location to abut the bracket or other stop member with minimal rotation of the roll bar and without such proper positioning of the studs, there is undesirable play allowing bellowing of the awning sheet wrapped around the roll bar with air currents traversing the stored awning. Previously, the positioning of the studs on the end cap of the roll bar has been changed after the awning is mounted by removing the studs and remounting them by drilling holes and riveting at the desired locations. As will be appreciated, this not only leaves undesirable holes in the roll bars which are displeasing from an aesthetic standpoint, but also creates an additional undesirable task when properly mounting the awning.

OBJECTS OF THE INVENTION

It is a primary object of the present invention to provide a new and improved roll bar device for retractable awnings which facilitates assembly of the awning and improves operational characteristics of the awning.

It is another object of the present invention to provide a new and improved roll bar device for retractable awnings which includes means for facilitating the connection of a sheet of awning material to the roll bar.

It is another object of the present invention to provide a new and improved roll bar device for retractable awnings which includes a new and improved system for preventing bellowing of the awning sheet in a retracted position.

DESCRIPTION OF THE PREFERRED EMBODIMENT

Figure 1:
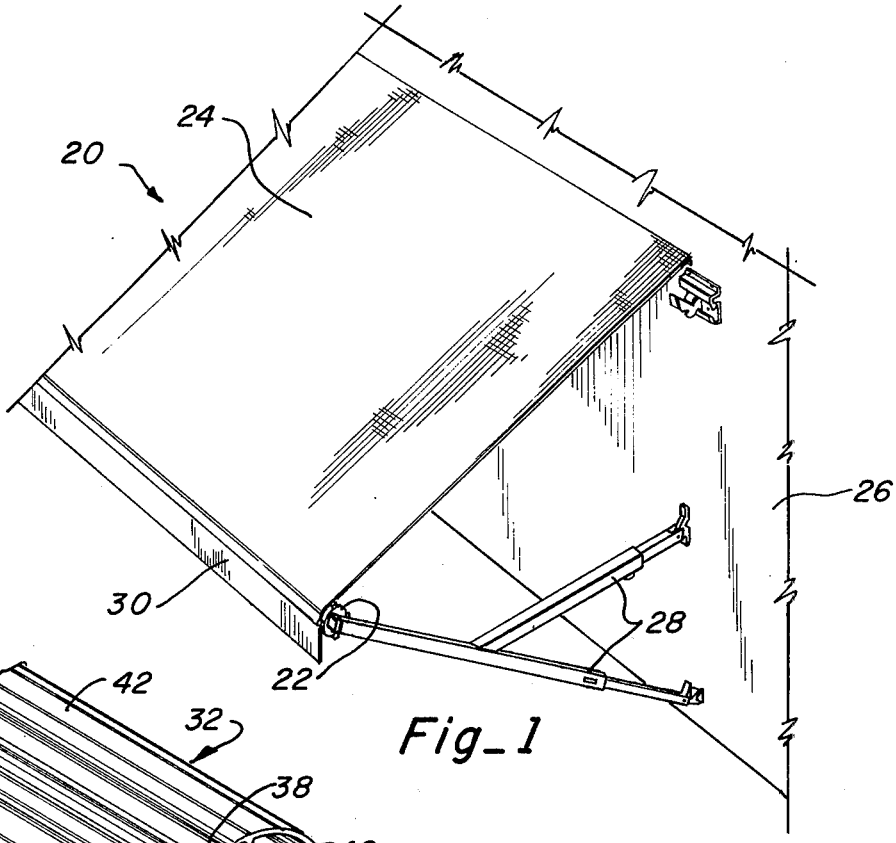
FIG. 1 is a fragmentary perspective view of a retractable awning incorporating the roll bar device of the present invention.

Referring first to FIG. 1, a retractable awning 20 is shown utilizing the roll bar device 22 of the present invention. The awning can be seen to include an awning sheet 24 secured along an inner edge to the side of a supporting surface 26 in a conventional manner, and a pair of brace members 28 at each end of the awning (only one pair being shown) which holds the awning in the extended position illustrated. The outer edge of the awning sheet 24 is shown connected to the roll bar device 22 of the present invention as is a valance 30 for the awning which lends to the aesthetics of the awning.

Figure 2:
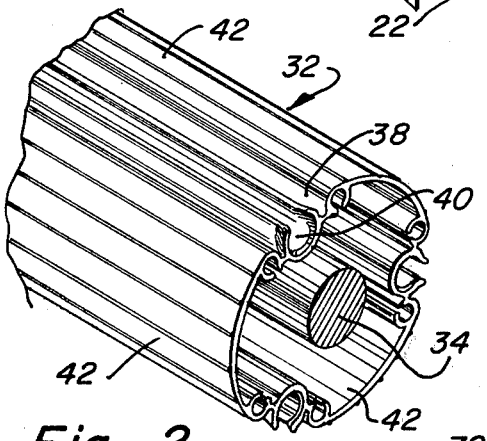
FIG. 2 is a fragmentary perspective view of the tubular element used on the roll bar device of the present invention.
Figure 7:
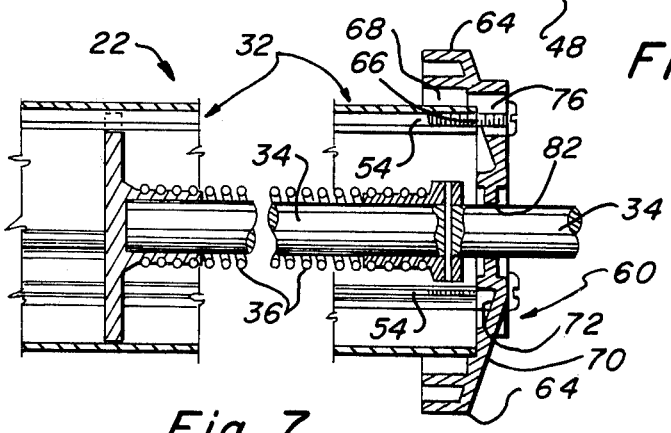
FIG. 7 is a fragmentary full section taken through the roll bar device of the present invention.
Figure 8:
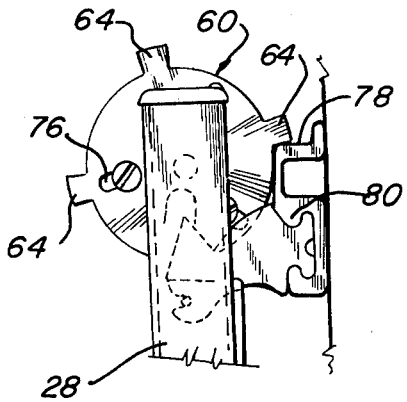
FIG. 8 is a fragmentary end elevation of the roll bar device of the present invention incorporated into the awning shown in FIG. 1 with the awning in a retracted position.

The roll bar device 22 is probably best shown in FIGS. 2 and 7 to include an elongated generally cylindrical tubular element 32 which internally receives and supports a pair of pivot shafts 34, one at each end, which extend axially of the tubular element and protrude out of each end. The pivot shafts 34 are mounted in the tubular element in a conventional manner and have mounted thereon a coil spring 36 which biases the roll bar in a preselected circumferential direction so that the awning will self-retract when the brace members 28 are released allowing the spring to rotate the roll bar and in so doing wrap the awning sheet 24 therearound until the roll bar is positioned adjacent the supporting surface 26 as illustrated in FIG. 8.

Figure 6:
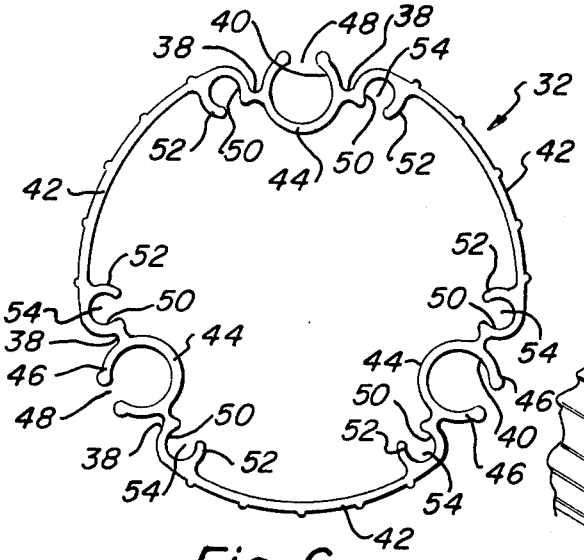
FIG. 6 is an end elevation of the tubular element of the roll bar device of the present invention.

As seen in FIG. 2 the elongated tubular element 32 has three axially extending indentations 38 spaced around its pheriphery with elongated notch-like grooves 40 disposed in the indentations. The particular configuration of the tubular element is probably best described by reference to its cross-section as illustrated in the end view of FIG. 6. It will there be appreciated that the element has three circular arcuate segments 42 with a common center, each segment being separated from an adjacent segment by an indentation 38. The indentation has the groove 40 disposed therein with the groove being defined by a semicircular bottom portion 44 which projects radially inwardly and a pair of arcuate lips 46 which project radially outwardly in a converging manner from opposite sides of the circular bottom portion 44 to a point where the outermost extremities of the lips are spaced a preselected distance to define a slot 48 therebetween. The outer extremities of the lips are seen to be slightly within the circle of which the three arcuate segments 42 are a part. Opposite side walls 50 of each indentation 38 cooperate with inwardly directly arcuate lips 52, which also terminate in spaced relationship from the associated side wall 50 of the indentation, to define generally circular openings 54 which, as will be explained later, are adapted to receive and retain screw-type fasteners 56, FIG. 7.

As will be appreciated, there are three grooves 40, one associated with each indentation 38 in the tubular element 32, and the grooves are equally spaced about the perimeter of the element. Since there are two of the fastener-receiving openings 54 associated with each groove 40, there are six openings 54 in the tubular element.

Figure 5:
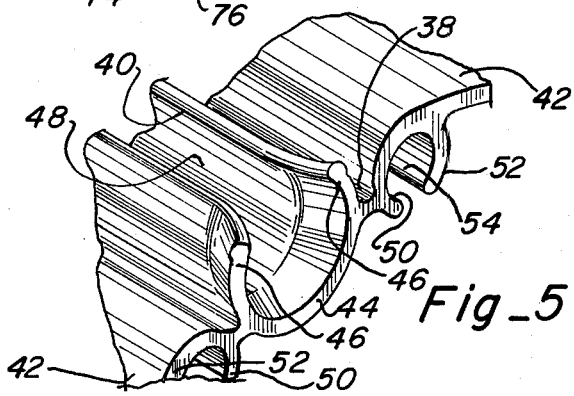
FIG. 5 is an enlarged fragmentary perspective view of the end of the tubular element of the roll bar device of the present invention showing a flaring at the end of a groove provided therein.
Figure 10:
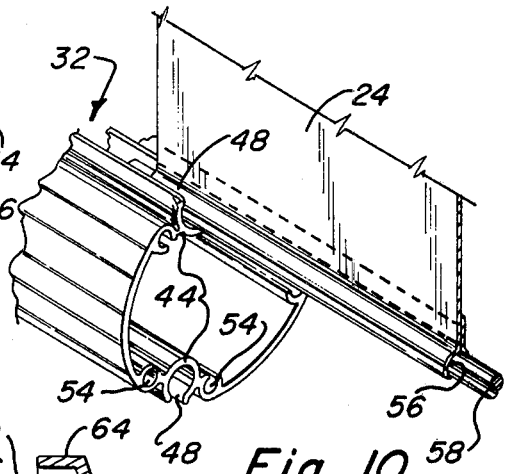
FIG. 10 is a fragmentary perspective view of the roll bar device of the present invention with an edge of an awning sheet being inserted thereinto.

Preferably, the roll bar 22 is made of a 6063-T5 aluminum alloy material having a thickness in the range of 0.065 to 0.07 inches so that the lips 46 at at least one end of the tubular element can be flared as shown in FIGS. 5 and 10 to facilitate insertion of the outer edge of the awning sheet into the groove in the roll bar. The outer edge of the awning sheet, as best seen in FIG. 10, has a loop or sleeve 56 formed therein and this sleeve is adapted to be slid into the groove 40 by inserting one end of the sleeve into one end of the groove and subsequently advancing the awning sheet along the tubular element 32 until the sleeve extends substantially the entire length of the tubular element. A retaining rod 58 is then inserted into the sleeve 56 within the groove 40. The rod 58 has a smaller diameter than the groove but is larger in diameter than the slotted opening 48 between the lips 46 so that the rod cannot be removed laterally from the roll bar and will thereby retain the awning sheet in the roll bar in a neat and attractive manner. Of course, the rod could be inserted into the sleeve of the awning material before the awning material is inserted into the roll bar but in either instance, it is desirable that the lips 46, on the end of the roll bar where the awning sheet is first inserted, be flared outwardly as illustrated in FIGS. 5 and 10 so that the awning material does not snag on the lips and thereby become damaged.

Only one of the grooves 40, of course, is used to retain the outer edge of the awning sheet so that the remaining two grooves can be used to support the valance 30 as illustrated in FIG. 1 and other accessories to an awning such as a screen enclosure or the like (not shown).

Figure 3:
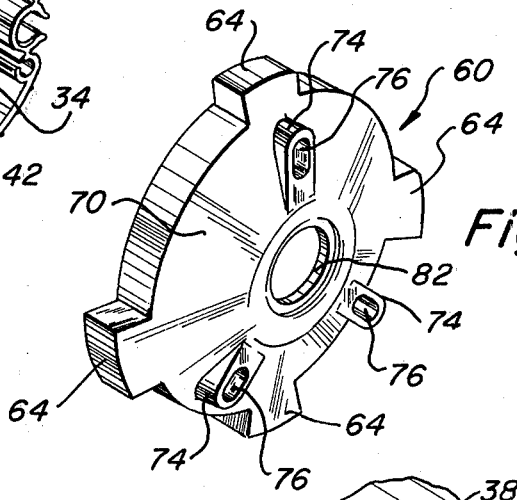
FIG. 3 is a perspective view of the end cap for the roll bar device of the present invention.
Figure 4:
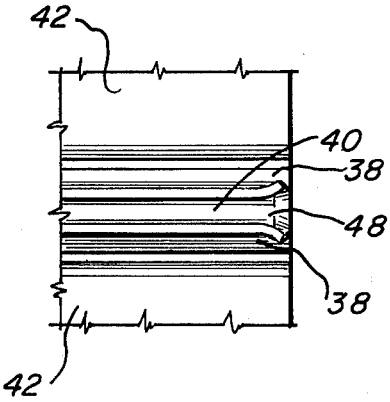
FIG. 4 is a fragmentary top plan view of the tubular element shown in FIG. 2.
Figure 9:
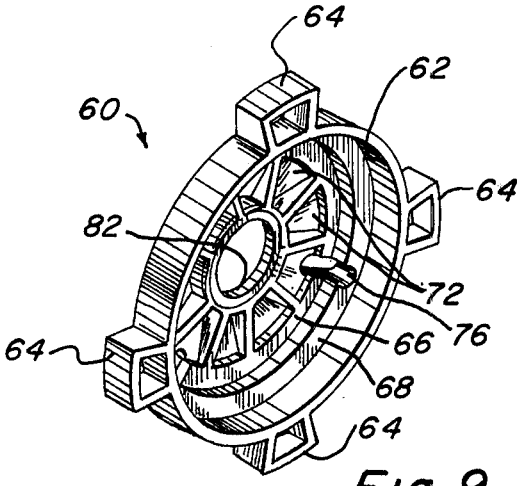
FIG. 9 is a perspective view of the end cap shown in FIG. 3.

The roll bar device also includes an end cap 60 which is best illustrated in FIGS. 3 and 9 to be of generally diskshaped configuration with a recess 62 in one face of the disk adapted to receive the end of the tubular element 32. The end cap is generally circular in configuration having four equally spaced radially extending studs 64 around its perimeter.

As best illustrated in FIG. 9, the recessed face of the end cap has two annular shoulders 66 and 68 around its perimeter with the smaller of the two annular shoulders 66 penetrating deeper into the end cap than the larger shoulder 68. These shoulders are adapted to seat and receive the end of the tubular element 32 and the different diameters of the two seats are for receiving different sized diameter tubular elements. As best appreciated in FIGS. 3 and 7, the outer end surface 70 of the end cap is generally frusto-conical in configuration. To render the end cap substantially uniform in thickness, a plurality of trapezoidal indentations 72 are formed in the rear face of the end cap. Three equally spaced bosses 74 are provided on the front face of the end cap and each boss has a generally oval-shaped aperture 76 therethrough with the apertures adapted to receive a screw-type fastener 56 which can be passed through the aperture and received in the openings 54 provided in the end of the tubular element. The oval configuration of the apertures 76 allows the screw-type fasteners to project into the end of a tubular element which is seated on either of the annular shoulders 66 or 68 in the rear face of the end cap. In other words, if a relatively large tubular element were seated in the end cap, the screw-type fasteners would be passed through the oval slot adjacent the outermost extent thereof whereas if a smaller tubular element were received in the end cap the screw-type fastener would be passed through the oval slot near the innermost extent thereof.

As mentioned previously, there are six openings 54 in each end of the tubular element to receive screw-type fasteners 56 whereas there are only three apertures 76 through the end cap thus giving the possibility of numerous angular relationships of the end cap to the tubular element dependent upon a selected set of three openings 54 in the tubular element for receiving screw-type fasteners passing through the apertures 76 in the end cap. As will be appreciated, the angular relationship of the end cap to the tubular element can be changed quickly and easily merely by removing and reinserting the fasteners in the desired set of openings. In this manner, referring to FIG. 8, a stud 64 on the outer pheriphery of the end cap can be angularly adjusted relative to the roll bar so that it abutts an upper surface 78 of the bracket 80 which supports the awning on the support surface 26 so that once the awning is positioned in the stored retracted position of FIG. 8, a stud 64 in cooperation with the bracket 80 will prevent undesired rotative movement of the roll bar thereby preventing the awning sheet, which is wrapped therearound, from bellowing when air currents pass across the retracted awning. Without this ability to quickly adjust the angular relationship of the end cap to the roll bar, it can be seen that a stud may not be properly positioned for cooperative abuttment with the bracket when the awning is rolled up.

The end cap 60 has a central axial passage 82 therethrough adapted to receive and rotatively support the outwardly extending pivot shaft 34 which is mounted in the tubular element so that the rod 34 can protrude from the end cap and be operatively connected to the end of one of the brace members 28 for desired mounting of the roll bar upon the brace members.

Although the present invention has been described with a certain degree of particularity, it is understood that the present disclosure has been made by way of example and that changes in details of structure may be made without departing from the spirit thereof.

What I claim is:

1. A roll bar for receiving and retaining one edge of an awning sheet so that the awning sheet can be wrapped therearound, including an elongated tubular element having a transverse cross-section defined by at least two spaced circular arcuate segments with a common center, inward indentations separating the arcuate segments, and lip projecting upwardly from spaced locations in the indentations having the outer edges thereof spaced to define a gap therebetween, said lips and indentations cooperating in defining an open groove in which said one edge of an awning sheet can be retained.

2. The roll bar of claim 9 wherein said indentations have circular arcuate bottoms and said lips define substantially radial projections from opposite sides of said bottoms and thereby cooperate in defining an open groove of substantially circular cross-section.

3. The roll bar of claim 1 wherein the transverse cross-section of said roll bar further includes inward projections from said arcuate segments defining substantially circular slot-like openings adapted to releasably receive screw-type fasteners.

4. In the retractable awning of claim 3, further including an end cap adapted to be secured to an end of said tubular element, said end cap comprising a recessed disk having a plurality of apertures therethrough, said apertures being axially alignable with at least some of said openings in the end of the tubular element so that screw-type fasteners can be passed through the apertures and received in aligned ones of said openings to secure the end cap to the end of the roll bar.

5. In the retractable awning of claim 4, said end cap further including a plurality of radially projecting studs at spaced locations around the perimeter thereof.

6. In the retractable awning of claim 5, there being more of said openings in the roll bar than apertures in the end cap so that the end cap can be secured to the roll bar in any one of a plurality of angular relationships.

* * * * *